US006840200B2

(12) United States Patent
Miller

(10) Patent No.: US 6,840,200 B2
(45) Date of Patent: Jan. 11, 2005

(54) ELECTROMECHANICAL VALVE ASSEMBLY FOR AN INTERNAL COMBUSTION ENGINE

(75) Inventor: John Michael Miller, Saline, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 240 days.

(21) Appl. No.: 09/732,282

(22) Filed: Dec. 7, 2000

(65) Prior Publication Data

US 2002/0069841 A1 Jun. 13, 2002

(51) Int. Cl.[7] ..... F01L 9/04

(52) U.S. Cl. ..... 123/90.11; 251/129.11; 123/90.28; 123/188.4

(58) Field of Search ..... 123/90.11, 90.1, 123/90.28, 188.2, 188.4, 568.23, 90.12; 251/129.11, 129.12

(56) References Cited

U.S. PATENT DOCUMENTS

| | | | | | |
|---|---|---|---|---|---|
| 4,097,786 | A | * | 6/1978 | Lund | 318/282 |
| 4,256,065 | A | * | 3/1981 | Hirt | 123/90.11 |
| 4,452,423 | A | * | 6/1984 | Beblavi | 251/65 |
| 4,777,915 | A | * | 10/1988 | Bonvallet | 123/90.11 |
| 4,994,721 | A | | 2/1991 | Plotnikov et al. | |
| 5,010,862 | A | | 4/1991 | Hashimoto et al. | |
| 5,094,426 | A | | 3/1992 | Zajac | |
| 5,318,064 | A | * | 6/1994 | Reinicke | 137/487.5 |
| 5,456,223 | A | | 10/1995 | Miller et al. | |
| 5,485,760 | A | | 1/1996 | Lange | |
| 5,592,905 | A | * | 1/1997 | Born | 123/90.11 |
| 5,598,814 | A | * | 2/1997 | Schroeder et al. | 123/90.11 |
| 5,606,957 | A | * | 3/1997 | Feucht | 123/571 |
| 5,669,341 | A | * | 9/1997 | Ushirono | 123/90.11 |
| 5,671,705 | A | * | 9/1997 | Matsumoto et al. | 123/90.11 |
| 5,720,468 | A | * | 2/1998 | Morinigo | 251/129.1 |
| 5,730,091 | A | * | 3/1998 | Diehl | 123/90.11 |
| 5,782,211 | A | * | 7/1998 | Kamimaru | 123/90.11 |
| 5,784,922 | A | * | 7/1998 | Ozaki et al. | 74/89.37 |
| 5,832,944 | A | * | 11/1998 | Lindner | 137/1 |
| 5,931,142 | A | | 8/1999 | Gerling | |
| 5,964,192 | A | * | 10/1999 | Ishii | 123/90.11 |
| 5,983,847 | A | * | 11/1999 | Miyoshi | 123/90.11 |
| 6,089,536 | A | | 7/2000 | Watanabe et al. | |
| 6,101,889 | A | | 8/2000 | Laskey | |
| 6,109,589 | A | * | 8/2000 | Ackermann | 251/65 |
| 6,224,034 | B1 | * | 5/2001 | Kato | 251/164 |
| 6,425,355 | B1 | * | 7/2002 | Van Der Staay | 123/90.11 |
| 6,446,519 | B1 | * | 9/2002 | Biester | 74/89.16 |

FOREIGN PATENT DOCUMENTS

JP 08-014018 A 1/1996

OTHER PUBLICATIONS

Rassem R. Henry, "A Novel, Fully Flexible, Electro–Mechanical Engine Valve Actuation System", 1997.

* cited by examiner

*Primary Examiner*—Thomas Denion
*Assistant Examiner*—Jaime Corrigan

(57) ABSTRACT

An electromechanical valve assembly 46 for an internal combustion engine 36 is provided. The valve assembly 46 includes a rotor 68 centered about a first axis 122 having a bore 114 extending generally axially therethrough. The valve assembly 46 further includes a stator 66 operatively disposed about the rotor 68 for producing a torque to cause rotation of the rotor 68 about the axis 122. Finally, the valve assembly 46 includes a valve 70 having a valve stem 126 and a valve head 84 The valve stem 126 extends generally axially through the bore 114 of the rotor 68. The valve stem 126 is also configured to move generally axially responsive to the rotation of the rotor 68 to selectively engage and disengage the valve head 84 with a valve seat 124 of the engine 36.

16 Claims, 8 Drawing Sheets

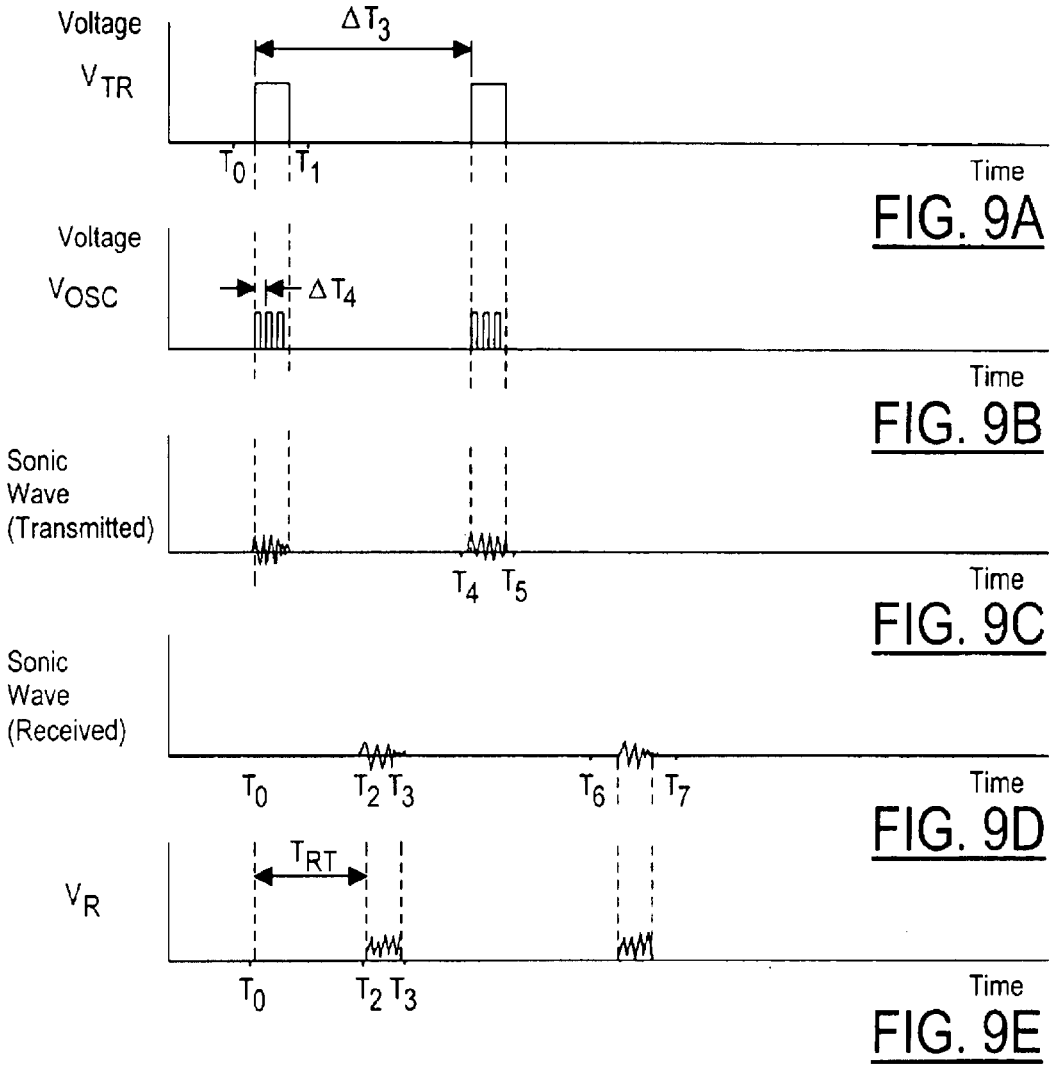
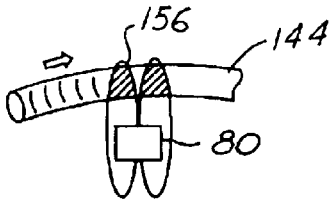
FIG. 10
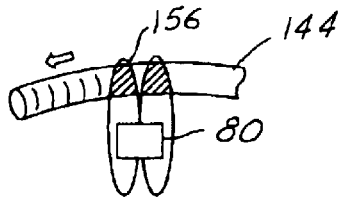
FIG. 11

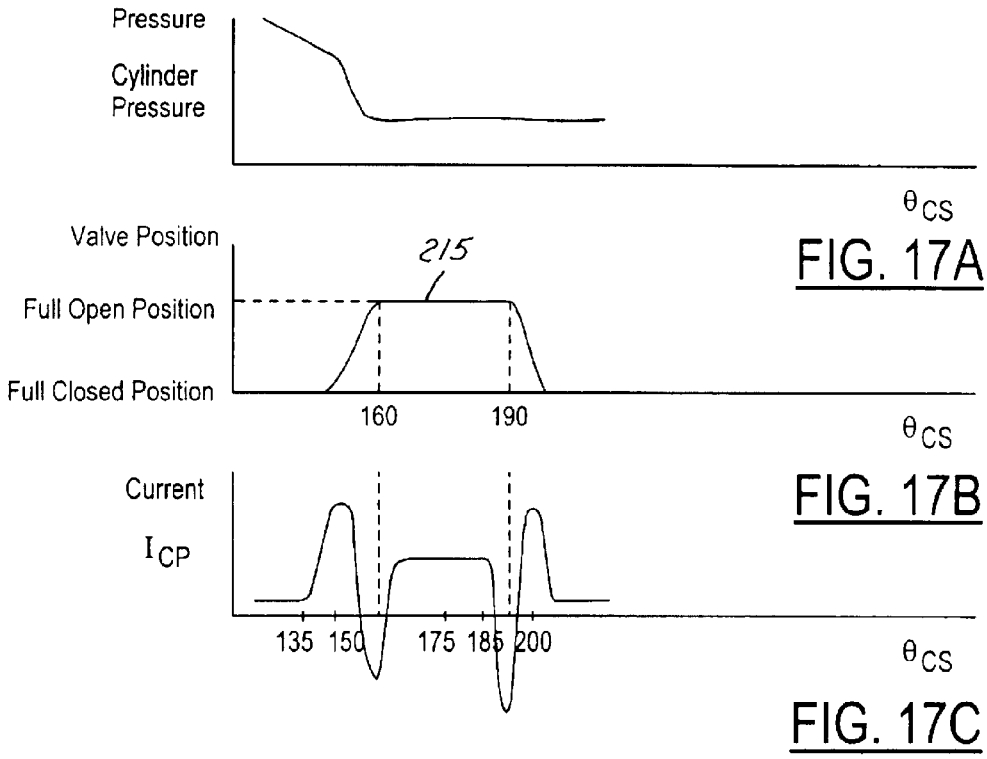
FIG. 17A
FIG. 17B
FIG. 17C
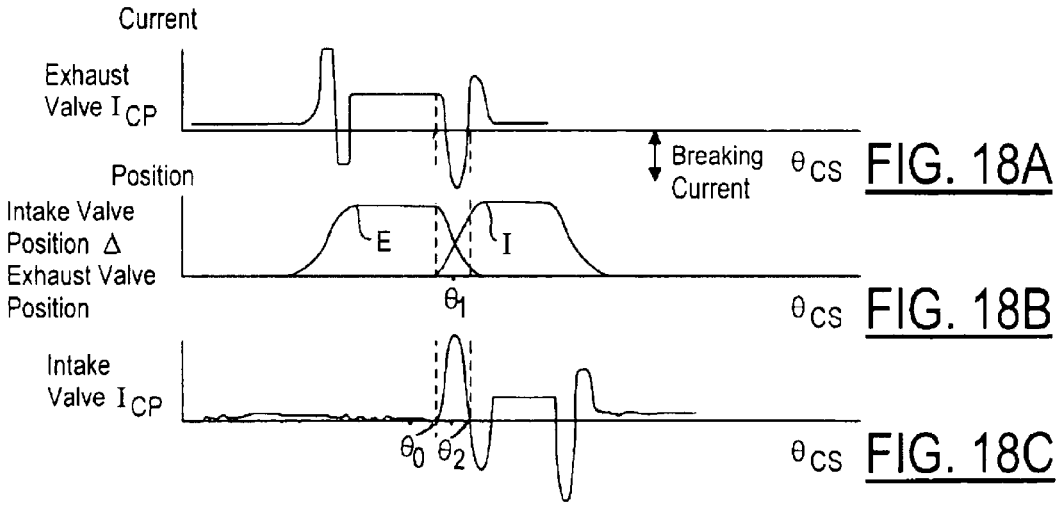
FIG. 18A
FIG. 18B
FIG. 18C

ELECTROMECHANICAL VALVE ASSEMBLY FOR AN INTERNAL COMBUSTION ENGINE

FIELD OF THE INVENTION

This invention relates to an engine valve assembly, and particularly, to an electromechanical valve assembly for an internal combustion engine.

BACKGROUND OF THE INVENTION

Automotive manufacturers are currently utilizing camless intake and exhaust valve assemblies to control fluid communication in engine cylinders of internal combustion engines. The camless valve assemblies may utilize hydraulic, pneumatic, or electromechanical means to move a valve.

It is further known that varying an engine valve dwell time (i.e., the time interval a valve is open), a valve dwell position (i.e., the amount the valve is open), a valve opening rate, a valve closing rate, and an initial opening time of a valve (i.e., valve phasing) may be used to increase fuel efficiency and lower emissions. Further, the most flexible valve assemblies may be independently actuated/controlled with respect to other valve assemblies in an engine.

Referring to FIG. 1, a known engine 10 having an engine head 12 and electromechanical valve assemblies 14, 16 is shown. The engine head 12 includes an air intake line 18 and an exhaust line 20. The valve assemblies 14, 16 control communication between the line 18, 20, respectively, with an engine cylinder (not shown).

The valve assembly 14 includes a pair of solenoids 22, 24, and a valve 26. The valve 26 includes a valve stem 28 and a valve head 30. The solenoids 22, 24 are utilized to either open or close the valve 26. In particular, when the solenoid 24 is energized (and solenoid 22 is de-energized), the valve head 30 is moved axially away from a valve seat 32 to allow fluid communication between the intake line 18 and a cylinder (not shown). When the solenoid 22 is energized (and solenoid 24 is de-energized) the valve head 30 engages the valve seat 32 to prevent fluid communication between the intake line 18 and the cylinder. Thus, the known valve assembly 14 has a two-position valve 26 having either a full open state or a full closed state. As such, the valve assembly 14 has several operational disadvantages. In particular, the valve assembly 14 cannot precisely control a valve dwell time duration, a valve dwell position, a valve opening rate, a valve closing rate, valve phasing. Thus, the valve assembly 14 cannot be utilized to effectively increase fuel efficiency and lower emissions in an engine. Further, the valve assembly 14 does not provide for soft seating of the valve head 30 on the valve seat 32 under all operating conditions of the engine including temperature extremes and control strategy variations. As a result, the valve head 30 generates undesirable noise when contacting the valve seat 32.

Another known electromechanical valve assembly (not shown) includes an electric motor, a cam, and a poppet valve. The motor selectively rotates an output shaft that is connected to the cam. The cam converts that rotary motion of the output shaft to an axial motion of the poppet valve. This known valve assembly is capable of controlling a valve dwell time, a valve dwell position, a valve opening rate, and a valve closing rate. However, the known valve assembly suffers from several disadvantages. First, the valve assembly requires a separate cam resulting in increased component and manufacturing costs. Further, the valve assembly requires a relatively large package space since a separate cam is utilized for each poppet valve.

SUMMARY OF THE INVENTION

The present invention provides an electromechanical valve assembly for an internal combustion engine.

The electromechanical valve assembly in accordance with the present invention includes a rotor centered about a first axis having a bore extending generally axially therethrough. The valve assembly further includes a stator operatively disposed about the rotor for producing a torque to cause rotation of the rotor about the first axis. Finally, the at valve assembly includes a valve having a valve stem and a valve head. The valve stem extends generally axially through the bore of the rotor. The valve is also configured to move generally axially responsive to the rotation of the rotor to selectively engage and disengage the valve head with a valve seat of the engine. In particular, the valve stem may be threadably engaged with the rotor. Further, the valve stem may have multiple lead engagement with the rotor.

A control system for a linear actuated electromechanical valve assembly is also provided. The control system includes a valve controller for generating a commanded valve position signal to control the incremental axial position of the valve.

The valve controller can also vary a valve operational parameter. In particular, the valve operation parameter includes one or more of the following: a valve dwell time, a valve opening rate, a valve closing rate, a valve dwell position, and valve phasing. The control system also includes a position sensor that generates a signal responsive to an axial position of the valve.

A method for current recirculation (i.e., energy recovery) in electromechanical valve assemblies disposed in an internal combustion engine is also provided. The current recirculation methodology is a regenerative method that reduces the energy requirement of electromechanical valves during actuation of the valves. The method includes providing a first electromechanical valve assembly having first and second stator phases selectively connected between a first node and ground. The method further includes providing a second electromechanical valve assembly having third and fourth stator phases selectively connected between the first node and ground. The method further includes generating a braking current in the first and second stator phases of the first electromechanical valve assembly. Finally, the method includes connecting the third and fourth stator phases of the second electromechanical valve assembly to the first node to direct the braking current into the third and fourth stator phases as an accelerating current.

The electromechanical valve assembly and the control system related thereto, represent a significant improvement over conventional valve assemblies and control systems. In particular, the inventive valve assembly and control system enable the precise control of a valve dwell time, a valve opening rate, a valve closing rate, a valve dwell position, and valve phasing. As a result, the inventive valve assembly allows for increased fuel efficiency and lower emissions in an engine as compared with conventional valve assemblies. Further, the position of the valve head may be accurately controlled for soft seating with a valve seat—resulting in reduced engine noise. Still further, the valve assembly may be packaged in a relatively small package volume allowing automotive designers increased flexibility in placement of the engine. Finally, the inventive method of current recirculation provides for decreased electrical energy consumption by the inventive valve assembly as compared with conventional electromechanical valve assemblies.

These and other features and advantages of this invention will become apparent to one skilled in the art from the following detailed description and the accompanying drawings illustrating features of this invention by way of example.

BRIEF DESCRIPTION OF THE DRAWINGS

FIGS. 9A–9E are signal schematics illustrating signals in the magneto-strictive sensor shown in FIG. 8.

FIG. 10 is a schematic illustrating a sonic wave propagating through a sonic conduit to a stress boundary in the conduit.

FIG. 11 is a schematic illustrating a sonic wave being reflected in a sonic conduit from a stress boundary in the conduit.

FIGS. 17A–17C are signal schematics of valve operational parameters during an actuation of an intake valve.

FIGS. 18A–18C are signal schematics illustrating current recirculation in electromechanical valve assemblies in accordance with the present invention.

DETAILED DESCRIPTION OF THE PREFERRED EMBODIMENTS

Figure 1:
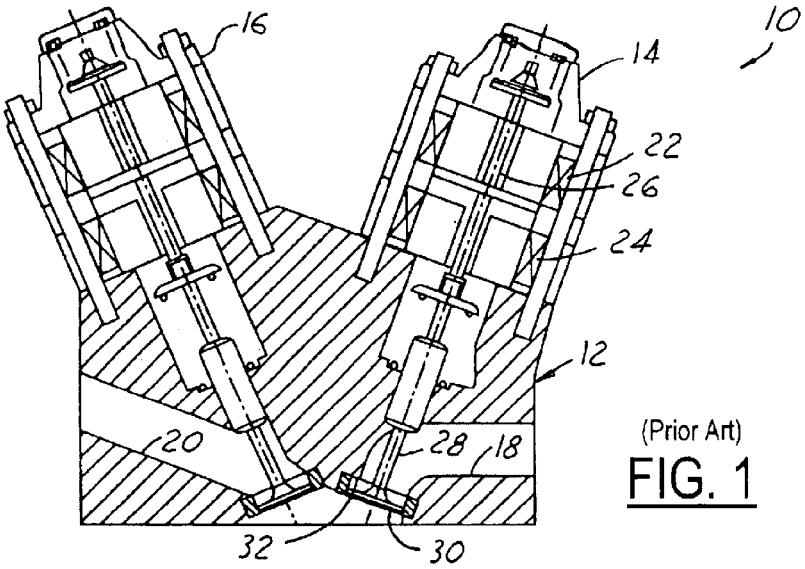
(Prior Art) FIG. 1
FIG. 1 is a schematic of an engine having two conventional electromechanical valve assemblies.
Figure 2:
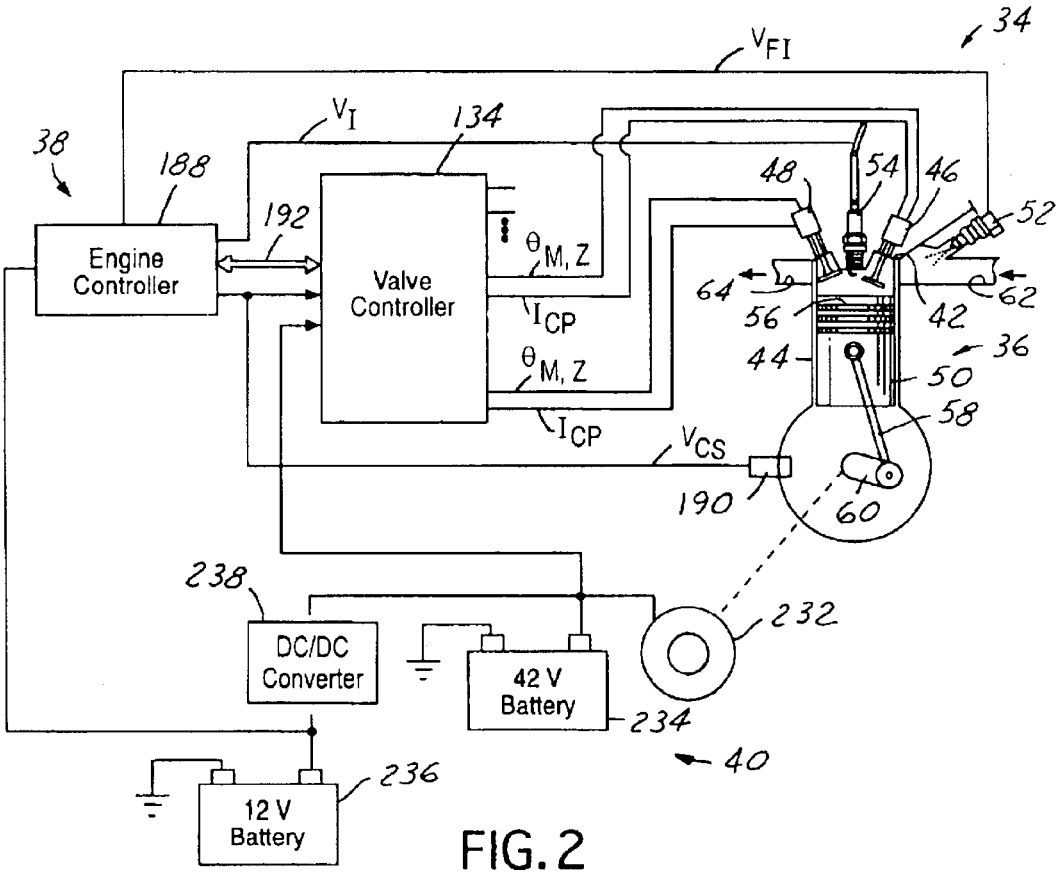
FIG. 2 is a schematic and block diagram of an automotive vehicle having an engine, an engine control system, and a power distribution system in accordance with the present invention.

Referring now to the drawings wherein like reference numerals are used to identify identical components in the various views, FIG. 2 illustrates an automotive vehicle 34 having an engine 36, an engine control system 38, and a power distribution system 40.

The engine 36 comprises an internal combustion engine. The engine 36 includes an engine head 42, an engine block 44, electromechanical valve assemblies 46, 48, a cylinder 50, a fuel injector 52, a spark plug 54, a piston 56, a connecting rod 58, and a crankshaft 60. Even though one cylinder 50 is shown in FIG. 2 for purposes of clarity, the engine 36 includes a plurality of cylinders 50, each cylinder 50 having valve assemblies 46, 48, fuel injector 52, spark plug 54, piston 56, and connecting rod 58.

The engine head 42 is conventional in the art and defines an intake line 62 and a exhaust line 64. The engine head 42 is mounted to the engine block 44 and is configured to hold the valve assemblies 46, 48, the spark plug 54, and the fuel injector 52.

The engine block 44 is conventional in the art and defines each of the cylinders 50. As illustrated, the engine block 44 is configured to receive the engine head 42.

The inventive electromechanical valve assemblies 46, 48 comprise an intake valve assembly and an exhaust valve assembly, respectively. The valve assembly 46 controls fluid communication between the intake line 62 and the cylinder 50. Similarly, the valve assembly 48 controls fluid communication of exhaust gases between the cylinder 50 and the exhaust line 64. Because the valve assemblies 46, 48 are substantially similar—with the only difference being valve assembly 46 having a larger valve face surface than valve assembly 48—only the valve assembly 46 will be described in detail hereinafter.

Before describing the various components of the electromechanical valve assembly 46, the operational advantages of the valve assembly 46 will be discussed. As previously discussed, when operating intake and exhaust valves in an engine, it is advantageous to vary various valve operational parameters to increase fuel efficiency and lower exhaust emissions. Because the valve assembly 46 has a valve 70 that may be selectively moved to commanded incremental axial positions (discussed in greater detail below), the valve assembly 46 provides for the precise control of several valve operational parameters.

Figure 7:
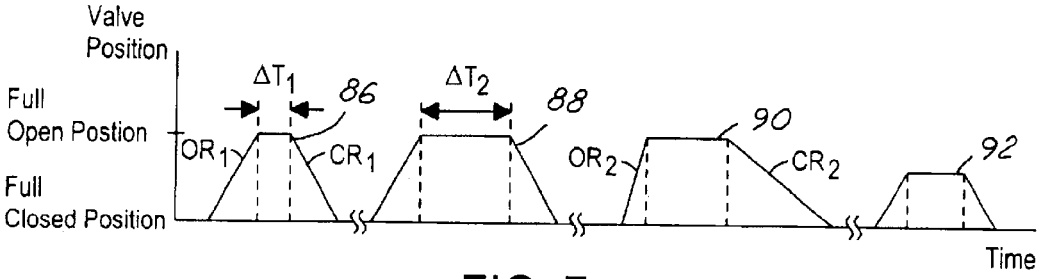
FIG. 7 is a signal schematic illustrating the valve operational parameters for the valve assembly shown in FIG. 3.

Referring to FIG. 7, four valve operational profiles 86, 88, 90, 92 showing the various operational parameters that may be incrementally varied by the valve 70 are shown. As previously discussed, the valve assembly 46 can selectively vary the opening rate of valve 70. For example, profiles 86, 90 illustrate two different possible opening rates $OR_1$ and $OR_2$ for the valve 70. Similarly, the valve assembly 46 can selectively vary the closing rate of the valve 70. For example, profiles 86, 90 illustrate two different possible closing rates $CR_1$ and $CR_2$ for the valve 70. Further, the valve assembly 46 can selectively vary the opening rate of the valve 70 independent of the closing rate of the valve 70, and vice versa, as shown in profile 90. Those skilled in the art will recognize that the torque and inertia of the valve 70 and the rotor 68 limits the valve opening and closing slew rates. In particular, the opening slew rate $OR_{SLEW}$ may be determined by the following equation:

$$OR_{SLEW}=(\text{torque applied to rotor/inertia of rotor and valve})$$

The assembly 46 may further selectively vary the dwell time of the valve 70. For example, profiles 86, 88 illustrate two possible dwell times $\Delta T_1$ and $\Delta T_2$, respectively, for the valve 70.

The assembly 46 can further move the valve 70 to a desired dwell position other than a full open position as shown in profile 92.

Figure 3:
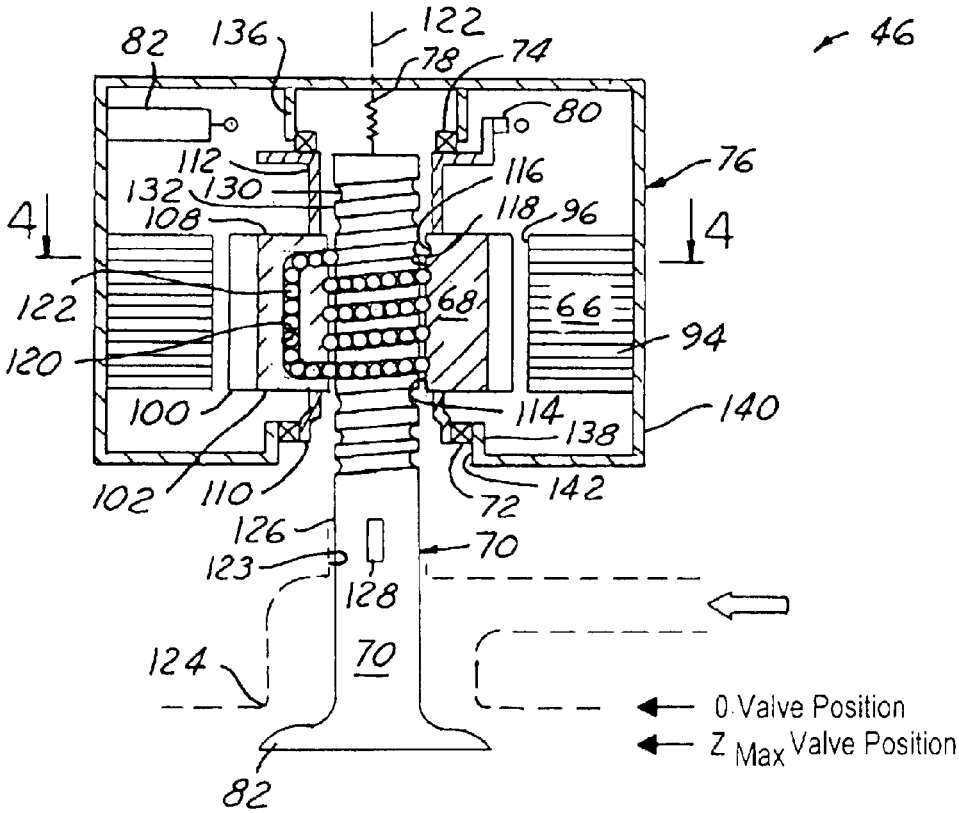
FIG. 3 is a schematic of an electromechanical valve assembly in accordance with a first embodiment of the present invention.

Referring to FIG. 3, the valve assembly 46 includes a stator 66, a rotor 68, a valve 70, bearings 72, 74, an enclosure 76, a centering spring 78, a sensor magnet 80, and a position sensor 82.

The stator 66 is provided to produce a torque to cause rotation of the rotor 68. In the illustrated embodiment, the stator 66 and rotor 68 are configured as a brushless DC motor. However, one skilled in the art will realize that the stator 66 and rotor 68 could be configured as a switch reluctance motor or other motor configurations well known to those skilled in the art. As illustrated, the stator 66 is constructed from a plurality of laminated plates 94 stacked adjacent one another. Further, the stator 66 has a central bore 96 extending axially therethrough configured to receive the rotor 68. The illustrated stator 66 and rotor 68 comprise a three-phase (i.e., phases A, B, C) two-pole, brushless DC motor. Further, the number of slots Q required in the stator 66 may be determined using the following equation:

$Q=q*m*p$, wherein, q=number of slots/pole/phase, m=number of phases, p=number of poles in the stator 66.

Figure 4:
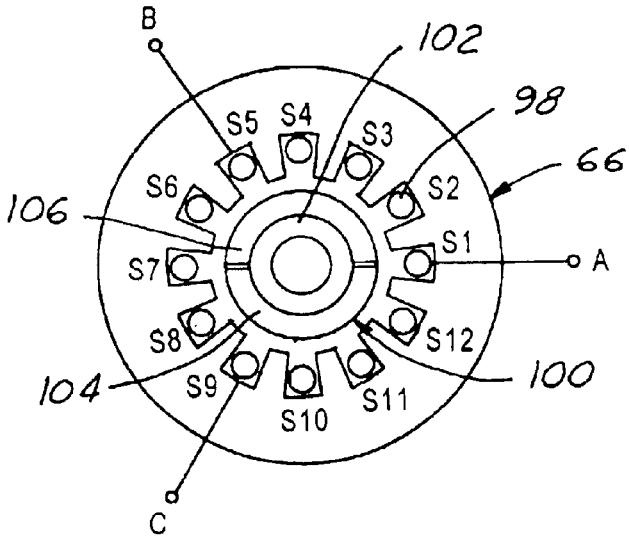
FIG. 4 is a cross-sectional view of the valve assembly shown in FIG. 3.
Figure 5:
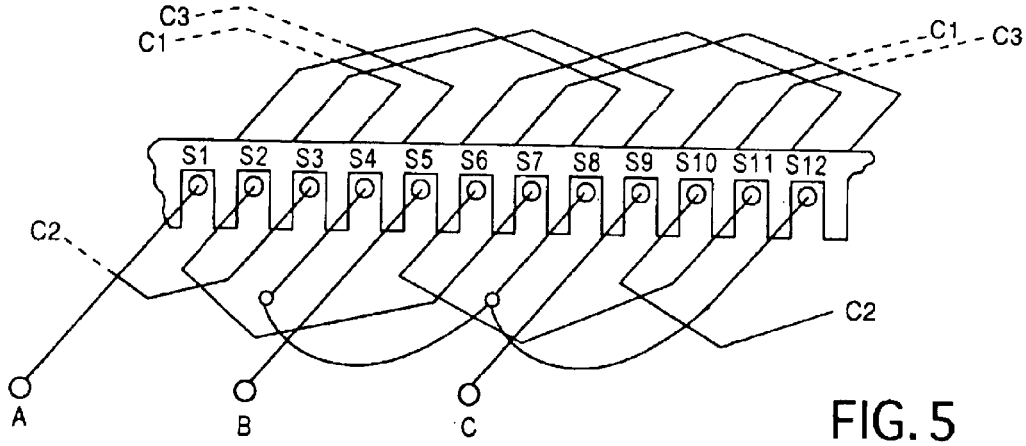
FIG. 5 is an electrical schematic illustrating the coil windings of the valve assembly shown in FIG. 4.

Accordingly, a three-phase, two-pole, brushless DC motor may have twelve slots (Q=2*3*2=12). Referring to FIGS. 4 and 5, the stator windings 98 may be routed in the stator slots S1-S12 to define the phases A, B, C. One skilled in the art will also recognize that the stator 66 and rotor 68 could alternately be constructed as a three-phase, four-pole brushless DC motor. Still further, the stator 66 and rotor 68 could have a higher number of poles if desired.

Referring to FIG. 3, the rotor 68 is provided to drive the valve 70 in a first and a second axial direction. The rotor 68 includes a ring magnet 100 and a ballnut 102.

Referring to FIG. 4, the ring magnet 100 may comprise magnet segments 104, 106, or may alternately comprise a single unitary magnet. In a preferred embodiment, the number of magnet segments of the magnet 100 is equal to the number of poles of the stator 66. Further each magnet segment has a flat inner surface that rests against a corresponding facet defined by an outer surface of the ballnut 102. As illustrated, the ring magnet 100 is fixedly attached around the ballnut 102 and may be glued to the ballnut 102.

Referring to FIG. 3, the ballnut 102 is provided to engage and drive the valve 70. The ballnut 102 is conventional in the art and may be constructed from a plurality of ferromagnetic materials including steel or iron. The ballnut 102 includes a cylindrical body portion 108 and mounting arms 110, 112.

The cylindrical body portion 108 has a central bore 114 configured to receive the valve 70 therein. The body portion 108 has a helical groove 116 separated by a land portion 118. The body portion 108 further includes a return channel 120 for recirculating a train of abutting load ball bearings 122 that travel in the groove portions 116. The return channel 120 may comprise an internal U-shaped channel machined within the body portion 108. The recirculation of the bearings 122 will be discussed in greater detail hereinbelow.

The mounting arms 110, 112 are provided to rotatably support the rotor 68 about an axis 122. The mounting arm 110 is attached to a lower end of the ballnut 102 and is further attached to the bearing 72. The mounting arm 112 is attached to an upper end of the ballnut 102 and is further attached to the bearing 74. Thus, the rotor 68 may rotate in either a clockwise or counter-clockwise direction about the axis 122.

The valve 70 is provided to selectively engage or disengage a valve seat 124. The valve 70 may be constructed from a plurality of materials including, for example, case hardened steel or ceramics such aluminum nitride. The material used for constructing the valve 70 preferably has a relatively low mass so that the valve 70 may be easily accelerated. The valve 70 includes a valve stem 126, a valve head 84, and an anti-twist guide 128.

Figure 6:
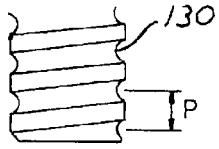
FIG. 6 is a fragmentary view of a valve stem of the valve assembly shown in FIG. 3.

The valve stem 126 has a helical groove 130 that is separated by a land portion 132. The helical groove 130 has the same pitch as the helical groove 116 of the ballnut 102. Accordingly, the helical grooves 116, 130 form a raceway between the rotor 68 and the valve 70. Upon rotation of the rotor 68, the ball bearings 122 travel in the helical grooves 116, 130 and are recirculated in the raceway by the return channel 120. Referring to FIG. 6, the helical groove 130 of the valve stem 126 has a thread or groove pitch P. The relationship between the rotational position $\theta_N$ of the rotor 68 and the axial position of the valve 70 is defined by the following equation:

$\theta_M=(2\pi/P)*Z$; wherein,

P=pitch of the helical grooves 116, 130,

Z=axial position of the valve 70

In a constructed embodiment, the thread pitch P is set equal to a maximum valve stroke $Z_{MAX}$. Accordingly, one rotation of the rotor 68 results in the valve 70 moving an axial distance equal to the maximum valve stroke $Z_{MAX}$. In alternate embodiments of the valve 70 and the rotor 68, multiple rotations of the rotor 68 may be utilized to move the valve 70 to a maximum valve stroke $Z_{MAX}$. The valve stroke $Z_{MAX}$ is typically 8 mm, although the valve assembly 46 may be configured to have a valve stroke greater than or less than 8 mm.

During installation of the valve 70 in the valve assembly 46 and the engine 36, the valve stem 126 may be inserted through an aperture 123 in the engine head 42. Further, the rotor 68 may have a cylindrical cardboard section (not shown) disposed in the bore 114. The cardboard section is utilized to hold the ball bearings 122 in the return channel 120 prior to attaching the rotor 68 to the valve stem 126. During attachment of the valve stem 126 to the rotor 68, the rotor 68 is threadably received by the valve stem 126, which forces the cardboard section out of the bore 114. Further, the ball bearings 122 travel in the raceway defined by the grooves 116 and 130.

An alternate embodiment of the rotor 68 and the valve 70 may also be utilized. In particular, the body portion 108 of the rotor 68 may include a second helical groove (not shown) extending alongside groove 116. Further, the valve stem 126 of the valve 70 may include a second helical groove (not shown) extending alongside the groove 130. The two additional helical grooves form a second raceway (not shown) for a second set of ball bearings to travel therein. Further, the second set of ball bearings are recirculated in the second raceway via a second return channel (not shown). By utilizing a second set of recirculating ball bearings, the effect of side loading forces on the valve 70 may be reduced.

The spring 78 is provided to center the valve 70 at a predetermined axial position when the engine 36 is shutdown (and the stator 66 is de-energized). This initial reference position may be measured by a position sensor and may be stored by a valve controller 134 for calculating the relative position of the valve 70 with respect to the initial position. As illustrated, the spring 78 is connected between one end of the valve stem 126 and the enclosure 76. Referring to FIG. 3, the spring 78 may be selected to center the valve 70 at any desired initial between the 0 valve position and the $Z_{MAX}$ valve position. For example, each of the springs 78 may be preloaded to each valve 70 in a closed position (i.e., 0 valve position)—to minimize a cranking torque of an integrated starter/alternator of the engine 36.

As previously discussed, the valve head 84 is configured to engage the valve seat 124 of the engine 36. As illustrated, the valve head 84 may be integrally connected to the valve stem 126.

The anti-twist guide 128 is provided to prevent rotational movement of the valve 70 about the axis 122. The anti-twist guide 128 may comprise a radially extending engagement portion connected to the valve stem 126 that engages a slot or keyway (not shown) in the engine head 42. Preventing rotation of the valve 70 provides several advantages. First, the valve 70 will less likely deteriorate the valve seat 124 if the valve 70 does not rotate while engaging the valve seat 124. Second, the axial position of the valve 70 may be accurately determined if the valve 70 does not rotate relative to the rotation of the rotor 68.

The bearings 72, 74 are provided to allow rotation of rotor 68 relative to the stator 66 and are conventional in the art. As illustrated, the bearing 74 is connected between a mounting arm 112 of the rotor 68 and an upper mounting arm 136 of the enclosure 76. Similarly, the bearing 72 is connected between the mounting arm 110 of the rotor 68 and a lower mounting arm 138 of the enclosure 76.

The enclosure 76 is provided to enclose and protect the stator 66, the rotor 68, and portions of the valve 70. Further, the enclosure 76 is mounted to the engine head 42. The enclosure 76 includes an outer wall 140, an upper mounting arm 136, and a lower mounting arm 138. The outer wall 140 defines a bore 142 for the valve stem 126 to extend therethrough.

The sensor magnet 80 is provided to indicate the rotational position of the rotor 68. As illustrated, the magnet 80 may be connected to a mounting arm 112 of the rotor 68.

Figure 8:
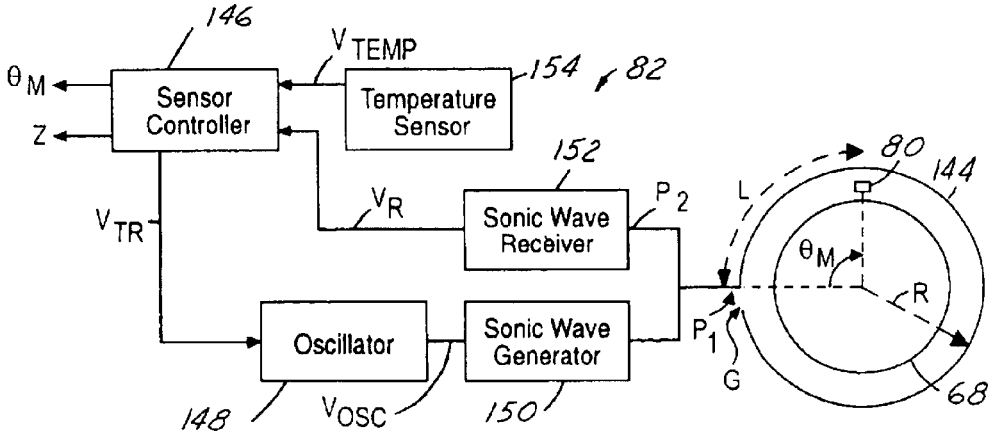
FIG. 8 is a schematic and block diagram of a magneto-strictive sensor in accordance with the present invention.

The position sensor 82 is provided to determine the rotational position $\theta_M$ of the rotor 68 and an axial position Z of the valve 70 in accordance with the present invention. The position sensor 82 may comprise a magneto-strictive sensor that has a relatively small package space as compared with conventional position sensors. Referring to FIG. 8, the magneto-strictive sensor 82 includes a sonic conduit 144, a sensor controller 146, an oscillator 148, a sonic wave generator 150, a sonic wave receiver 152, and a temperature sensor 154.

The sensor controller 146 is provided to calculate a rotational position $\theta_M$ of the rotor 68 and an axial position Z of the valve 70. The controller 146 may comprise either discrete circuits or a programmable microcontroller. As illustrated, the sensor controller 146 is electrically connected to the oscillator 148, the sonic wave receiver 152, and the temperature sensor 154. The sensor controller 146 is configured to generate a transmit signal $V_{TR}$ at a predetermined frequency that is transmitted to the oscillator 148. In a constructed embodiment, the transmit signal $V_{TR}$ is transmitted at a frequency of 100 Khz. The sensor controller 146 receives the temperature signal $V_{TEMP}$, the received signal $V_R$, (explained in detail hereinafter) and the oscillator signal $V_{OSC}$(explained in detail hereinafter), and calculates the rotational position $\theta_M$ of the rotor 68 and an axial position Z of the valve 70.

The oscillator 148 is provided to generate an oscillator signal $V_{OSC}$ responsive to the transmit signal $V_{TR}$. The oscillator 148 may comprise a conventional voltage controlled oscillator or discrete circuits. As illustrated, the oscillator 148 is electrically connected in series between the sensor controller 146 and the sonic wave generator 150. Referring to FIGS. 9A and 9B, the oscillator 148 receives a transmit signal $V_{TR}$ at a high logic level and generates an oscillator signal $V_{OSC}$ at a 1 Mhz frequency responsive thereto. Those skilled in the art will recognize that the frequency of the transmit signal $V_{TR}$ and the oscillator signal $V_{OSC}$ may be greater than or less than 100 Khz or 1 Mhz, respectively, depending upon the desired accuracy of the calculated rotational position $\theta_M$ and the axial position Z. The frequency of the oscillator signal $V_{OSC}$ (frequency of $V_{OSC}=(1/\Delta T_4)$) is preferably ten times greater than the frequency of the transmit signal $V_{TR}$ (frequency of $V_{TR}=(1/\Delta T_3)$). Further, the frequency of the transmit signal $V_{TR}$ is preferably greater than twice the round trip travel time $T_{RT}$ (explained in greater detail below) of the sonic wave.

The sonic wave generator 150 is provided to generate a sonic wave in the sonic conduit 144. The sonic wave generator 150 may comprise a conventional piezoelectric transducer and is electrically connected to the oscillator 148 and is further bonded to the sonic conduit 144. The generator 150 receives the oscillator $V_{OSC}$ and generates a sonic wave (i.e., sound wave) in the conduit 144 responsive to the oscillator signal $V_{OSC}$.

The sonic conduit 144 is provided to propagate a sonic wave in the conduit 144 around a portion of a circumference of the rotor 68. The sonic conduit 144 may comprise a metal wire or a metal strip that extends around a substantial portion of the circumference of the rotor 68 proximate to the rotor 68. The conduit 144 may be constructed from a plurality of metals, including for example, a nickel-iron alloy. In a constructed embodiment, the conduit 144 is constructed of 18 gauge wire. Referring to FIGS. 8 and 10, the sensor magnet 80 disposed on the rotor 68 induces a localized stress boundary 156 on the conduit 144 proximate to the magnet 80. In particular, the magnet 80 deforms the conduit 144. Accordingly, the magnet 80 and the boundary 156 are indicative of the position of the rotor 68. Accordingly, a sonic wave traveling in the conduit 144 in a first direction to the stress boundary 156, will be reflected from the boundary 156 in a second direction (opposite the first direction). The gap G in the conduit 144 ensures that each the sonic wave initially propagates in only one direction (i.e., clockwise in FIG. 8) around the conduit 144 to the boundary 156.

Referring to FIG. 8, the sonic wave receiver 152 is provided to generate a received signal $V_R$ upon receipt of a sonic wave. The sonic wave receiver 152 may comprise a conventional piezoelectric transducer and is electrically connected to the sensor controller 146 and is further connected to the conduit 144. Referring to FIGS. 9D and 9E, at time interval $T_2$–$T_3$, the receiver 152 receives the sonic wave and generates the received signal $V_R$ responsive thereto.

The temperature sensor 154 generates a temperature signal $V_{TEMP}$ indicative of the ambient air temperature around the sonic conduit 144 and valve assembly 46. The temperature sensor 154 is conventional in the art and is electrically connected to the sensor controller 146.

Figure 12:
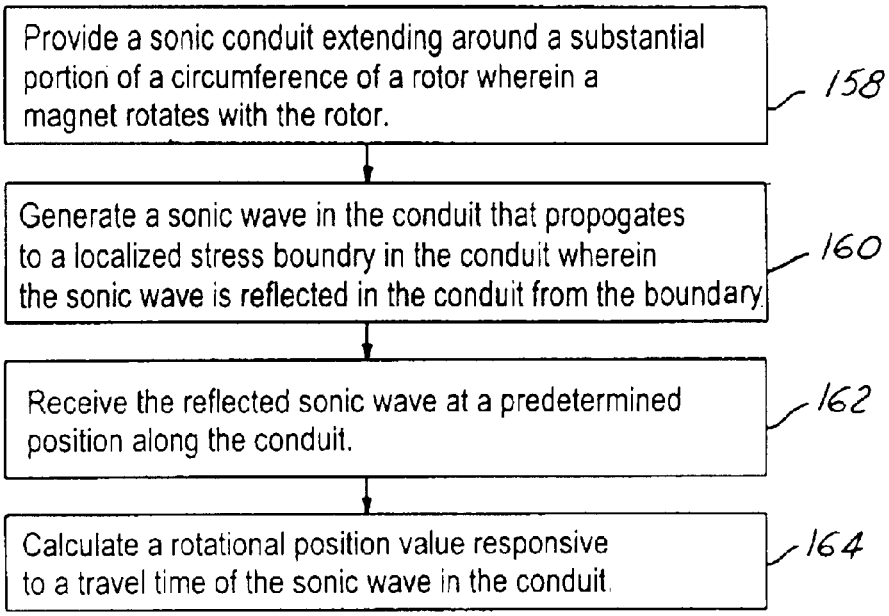
FIG. 12 is a flow chart illustrating a method for determining a rotational position of an object in accordance with the present invention.

Referring to FIG. 12, a method for determining a rotational position of the rotor 68 (i.e., object) utilizing the inventive position sensor 82 will be described. The method includes a step 158 of providing a sonic conduit 144 extending around a substantial portion of a circumference of the rotor 68.

The method further includes a step 160 of generating a sonic wave in the conduit 144 that propagates to a localized stress boundary 156 in the conduit 144 wherein the sonic wave is reflected in the conduit 144 from the boundary 156. Referring to FIGS. 9A, 9B, and 9C, the sensor controller 146 between the time interval $T_0$–$T_1$, generates a transmit signal $V_{TR}$ at high logic level that causes the oscillator 148 to generate oscillator signals $V_{OSC}$. The oscillator signals $V_{OSC}$ cause the sonic wave generator 150 to generate a sonic wave (i.e., vibration) in the conduit 144. The sonic wave propagates in a first direction to the stress boundary 156 and is reflected from the stress boundary 156 in a second direction (opposite the first direction) back toward a sonic wave receiver 152.

Referring to FIG. 12, the method further includes a step 162 of receiving the reflected sonic wave at a predetermined position along the sonic conduit 144. Referring to FIGS. 9D and 9E, during time interval $T_2$–$T_3$, the sonic wave is received by the sonic wave receiver 152. In response, the receiver 152 generates the received signal $V_R$ that is transmitted to the sensor controller 146.

Referring again to FIG. 12, the method further includes a step 164 of calculating a rotational position value $\theta_M$ of the rotor 68 and an axial position Z of the valve 70 responsive to the round trip travel time $T_{RT}$ of the sonic wave in the conduit 144. The equations used by the sensor controller 146 to calculate the rotational position $\theta_M$ of the rotor 68 and the axial position Z of the valve will now be explained. Referring to FIG. 8, the path length L may be determined utilizing the following equation:

$$L=(R*\theta_M)=(\mathrm{VEL}(T)*T_{RT}/2);\ \text{wherein,}$$

R=known radius of the sonic conduit 144, $\theta_M$=angular position of the sensor magnet 80, VEL(T)=velocity of the sonic wave in the sonic conduit 144 as a function of the temperature T, $T_{RT}$=round trip travel time of the sonic wave.

For purposes of illustration and simplicity, the conduit length from point P1 to point P2 is assumed to be zero. Accordingly, the rotational position $\theta_M$ of the rotor 68 may be calculated using the following equation:

$$\theta_M=(\mathrm{VEL}(T)/2R)*T_{RT}$$

Further, when the rotational position $\theta_M$ of the rotor 68 is known, the axial position Z of the valve 70 may be calculated using the following equation:

$$Z=\theta_M*P/2\pi;\ \text{wherein,}$$

P=pitch of the grooves 130 in the valve stem 126. As noted above, the velocity of the sonic wave is dependent on the temperature of the conduit 144. In particular, the following equation may be utilized to calculate the velocity sonic wave velocity:

$$\mathrm{VEL}\ (T)=\mathrm{VEL}_0[1+\alpha(T-T_0)];\ \text{wherein,}$$

$VEL_0$=velocity of sonic wave at temperature T=20° C., $\alpha$=temperature coefficient of sonic conduit material, $T_0$=20° C.

T=measured temperature of the conduit utilizing temperature sensor 154.

The foregoing equation for calculating VEL(T) represents a truncated Fourier expansion of non-linear velocity versus temperature relationship.

Figure 13:
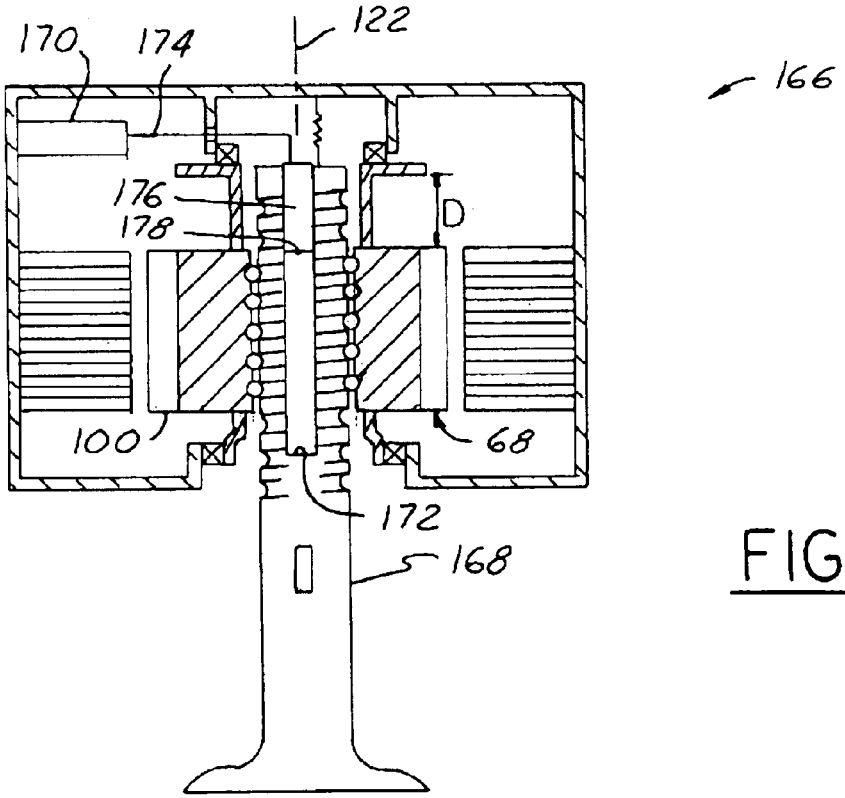
FIG. 13 is a schematic of an electromechanical valve assembly in accordance with a second embodiment of the present invention.

Referring to FIG. 13, an electromechanical valve assembly 166 is provided that is a second embodiment of the valve 46. The valve assembly 166 is substantially the same as the valve assembly 46, except that the sensor magnet 80 has been removed and a valve 168 and a position sensor 170 are used instead of valve 70 and position sensor 82, respectively.

The valve 168 is substantially the same as the valve 70 except that a valve 168 has a bore 172 extending axially into the valve 168.

The position sensor 170 is provided to calculate an axial position Z of the valve 168. The position sensor 170 is substantially the same as the position sensor 82 and includes the sensor controller 146, the oscillator 148, the sonic wave generator 150, the sonic wave receiver 152, and the temperature sensor 154. However, the position sensor 170 utilizes a flexible lead wire 174 and a sonic conduit 176 instead of the sonic conduit 144. As illustrated, the sonic conduit 176 may comprise a longitudinally extending metal wire or a metal bar that is disposed in the bore 172 of the valve 168. The conduit 176 may be constructed from a plurality of metals, including for example, a nickel-iron alloy. Further, the ring magnet 100 of the rotor 68 induces a localized stress boundary 178 in the conduit 176.

The axial distance D from a first end of the conduit 176 to the stress boundary 178 is indicative of the axial position of the valve 168. In particular, the distance D (and the round trip travel time $T_{RT}$ of a sonic wave) will increase as valve 168 incrementally moves in a first axial direction (downward in FIG. 13). Similarly, the distance D (and the round trip travel time $T_{RT}$ of the sonic wave) will decrease as the valve 168 moves in a second axial direction (upward in FIG. 13) opposite the first axial direction. Accordingly, the sensor controller 146 may calculate the axial position Z of the valve 168 utilizing the following equation:

$$Z=D=(\mathrm{VEL}(T)*T_{RT}/2).$$

For purposes of illustration and simplicity, the length of the lead wire 174 is assumed to be equal to a zero length.

Figure 14:
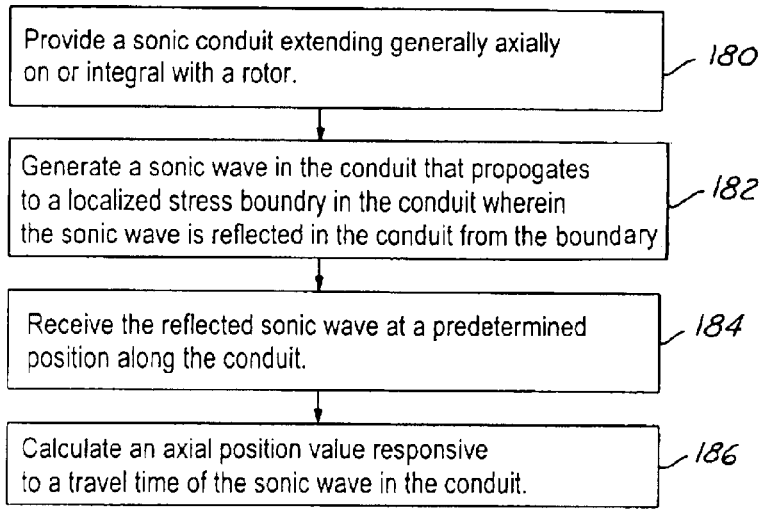
FIG. 14 is a flowchart illustrating a method for determining an axial position of an object in accordance with the present invention.

Referring to FIG. 14, a method for determining an axial position of a valve 168 utilizing the position sensor 170, will be described. The method includes a step 180 of providing a sonic conduit 176 extending generally axially on or integral with the valve 168. The method further includes a step 182 of generating a sonic wave in the conduit 176 that propagates to a localized stress boundary 178 wherein the wave is reflected from the boundary 178. The method further includes a step 184 of receiving the reflected sonic wave at a predetermined position along the conduit 176. Finally, the method includes a step 186 of calculating an axial position z of the valve 168 responsive to the travel time of the sonic wave in the conduit 176.

Referring to FIG. 2, the remaining elements of the engine 36 will be described. As previously discussed, the engine 36 includes the fuel injector 52. The fuel injector 52 selectively provides fuel to one or more cylinders 50 and is conventional in the art. In particular, each fuel injector 52 delivers a predetermined amount of fuel into one or more cylinders 50 responsive to a fuel injector control signal $V_{PI}$ generated by an engine controller 188.

The spark plug 54 is provided to ignite the fuel in the cylinder 50 responsive to an ignition control signal $V_I$ generated by the engine controller 188. When the fuel is ignited in the cylinder 50, the piston 56 drives the crankshaft 60 via the connecting rod 58.

Referring again to FIG. 2, the engine control system 38 is provided to control the operation of the engine 36 in accordance with the present invention. The engine control system 38 includes a valve controller 134, an engine controller 188, a crankshaft position sensor 190, and the valve position sensor 82.

The valve controller 134 is a bi-directional controller that can control the incremental movement of valves in both axial directions. For purposes of discussion it will be assumed that each of the valve assemblies 46, 48 includes a valve 70 and a position sensor 82. As illustrated, the valve controller 134 receives a rotational position value 0e and an axial position value Z from the position sensor 82, and a crankshaft position signal $V_{CS}$ from the crankshaft position sensor 190. Further, the valve controller 134 receives operational parameters from the engine controller 188 for each valve 70 via a communication bus 192. The communication bus may comprise a CAN (i.e., controller area network) bus operating at a bus speed of 1 megabit/second. The valve operational parameters include a valve dwell time, a valve opening rate, a valve closing rate, and valve phasing information. In response to the foregoing signals and parameters for each valve 70, the valve controller 134 generates a commanded valve position current $I_{CP}$—for each valve assembly 46, 48—to selectively control the axial position of each valve 70.

Figure 15:
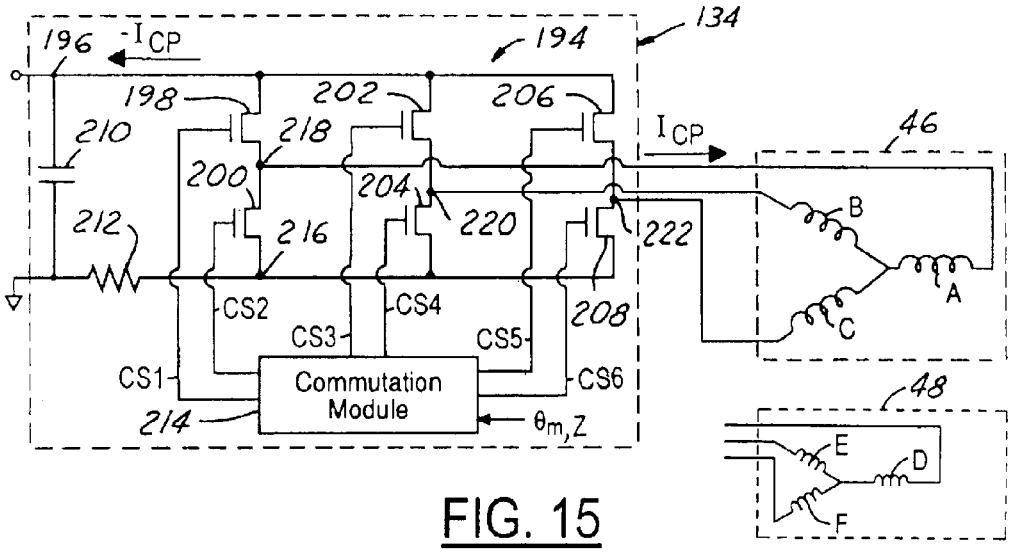
FIG. 15 is a circuit diagram illustrating a commutation circuit for controlling the electromechanical valve assemblies shown in FIGS. 3 and 13.

Referring to FIG. 15, a more detailed schematic of the valve controller 134 is illustrated. In particular, the valve controller 134 contains a conventional commutation circuit 194 for each valve assembly 46, 48 in the engine 36. For example, when engine 36 has four-cylinders and eight valve assemblies (four intake valve assemblies 46 and four exhaust valve assemblies 48), the valve controller 134 would have eight commutation circuits 194 to control the eight valve assemblies. Each of the circuits 194 would be connected between a node 196 (connected to a positive terminal of the battery 234) and system ground. Each commutation circuit 194 includes switches 198, 200, 202, 204, 206, 208, a capacitor 210, a resistor 212, and a commutation module 214.

Switches 198, 200, 202, 204, 206, 208 are provided to selectively energize the phases A, B, C of the stator 66. Switches 198, 200, 202, 204, 206, 208 are conventional in the art and may comprise either MOSFET transistors, IGBT transistors in either planar or trench structure, or bipolar transistors. Switches 198, 200 are connected in series between nodes 196, 216 and have an intermediate node 218 connected to phase A. Similarly, switches 202, 204 are connected in series between nodes 196, 216 and have an intermediate node 220 connected to phase B. Further, switches 206, 208 are connected in series between nodes 196, 216 and have an intermediate node 222 connected to phase C.

The capacitor 210 is provided to ground transient voltage spikes which could damage the switches 198, 200, 202, 204, 206, 208. As illustrated, the capacitor 210 is connected between the node 196 and ground.

The resistor 212 is provided to sense the current flow through the switches 198, 200, 202, 204, 206, 208 and to prevent damage thereto. The resistor 212 is connected between the node 216 and ground.

Figures 16A, 16B, 16C, 16D, 16E, 16F:
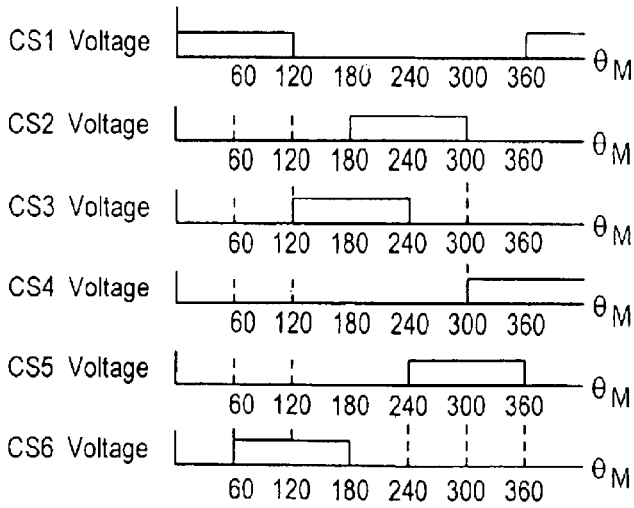
FIGS. 16A–16F are signal schematics of control signals generated by the commutation circuit shown in FIG. 15.

The commutation module 214 is provided to generate control signals to control the energization of the phases A, B, C of the stator 66. In particular, the commutation module 214 receives either the rotational position value $\theta_M$, or the axial position Z from the position sensor 82. In response, the commutation module generates commutation signals CS1, CS2, CS3, CS4, CS5, CS6 to selectively energize the phases A, B, C. Referring to FIG. 16, commutation signals CS1, CS2, CS3, CS4, CS5, CS6 are shown for energizing the phases A, B, C pairwise to move the rotor 68 one complete revolution (i.e., 360 mechanical degrees) are shown.

Referring to FIGS. 17B and 17C, a valve operational profile 215 (illustrating a complete operational cycle of a valve 70) and a corresponding commanded valve position current $I_{CP}$ effectuating the valve cycle is shown. FIG. 17A illustrates the pressure P within a cylinder 50 as the valve 70 progresses through the valve cycle. At crankshaft angle $\theta_{CS}$=135°, the valve controller 134 commands the valve 70 to move to an open position to allow exhaust gases in the cylinder 50 to exit the cylinder 50. In particular, the valve controller 134 increases the commanded valve position current $I_{CP}$ —in a positive direction—that results in the valve accelerating toward a full open position. As the valve 70 opens, the exhaust gas exits the cylinder 50 resulting in a decreasing cylinder pressure.

At crankshaft angle $\theta_{CS}$=150°, when the valve 70 is moving to the full open position, the valve controller 134 decreases the commanded position current $I_{CP}$. When the current $I_{CP}$ reverses direction as a negative or braking current, the valve 70 de-accelerates prior to reaching the full open position.

At crank shaft angle $\theta_{CS}$=160°, when the valve 70 has reached to the full open position, the controller 134 commences to decrease the negative current $I_{CP}$ until it reverses direction as a positive or holding current. Afterward, the controller 134 maintains the positive current $I_{CP}$ at an dwell current level for a desired dwell time. The holding current is necessary to counteract forces acting the valve 70 generated by the spring 78 and the cylinder gas pressure.

In response, the valve 70 is maintained at a full open position. Further, the cylinder pressure remains at a relatively constant pressure level.

At crankshaft angle $\theta_{CS}$=185°, the controller 134 commands the valve 70 to move to a closed position. In particular, the controller 134 decreases the current $I_{CP}$ until it reverses direction as a negative current. In response, the valve 70 accelerates toward a full closed position.

At crankshaft angle $\theta_{CS}$=190°, the controller 134 decreases negative current $I_{CP}$ until it reverses direction as a positive current to de-accelerate the valve 70 prior to the valve 70 reaching the full closed position. Accordingly, the de-acceleration of the valve 70 provides for soft seating of the valve 70 with the valve seat 124. Thus, engine noise may reduced.

Referring to FIG. 2, the engine controller 188 is provided to control the operation of the engine 36. The engine controller 188 may comprise either discrete circuits or a programmable microcontroller. The controller 188 receives a crankshaft position signal $V_{CS}$ and generates the fuel injector control signal $V_{FI}$ responsive thereto. As previously discussed, the controller 188 also calculates valve operational parameters for each valve including a dwell time duration, an opening rate, a closing rate, a dwell position, and phasing information. Further, the controller 188 transmits these operational parameters to the valve controller 134 via a communication bus 192.

The crankshaft position sensor 190 generates a crankshaft position signal $V_{CS}$ indicative of the rotational position of the crankshaft 60. The sensor 190 is conventional in the art and may comprise a Hall Effect Sensor or a variable reluctance sensor. The engine controller 188 may receive the crankshaft position signal $V_{CS}$ and derive the crankshaft angle $\theta_{CS}$ responsive thereto.

Figure 19:
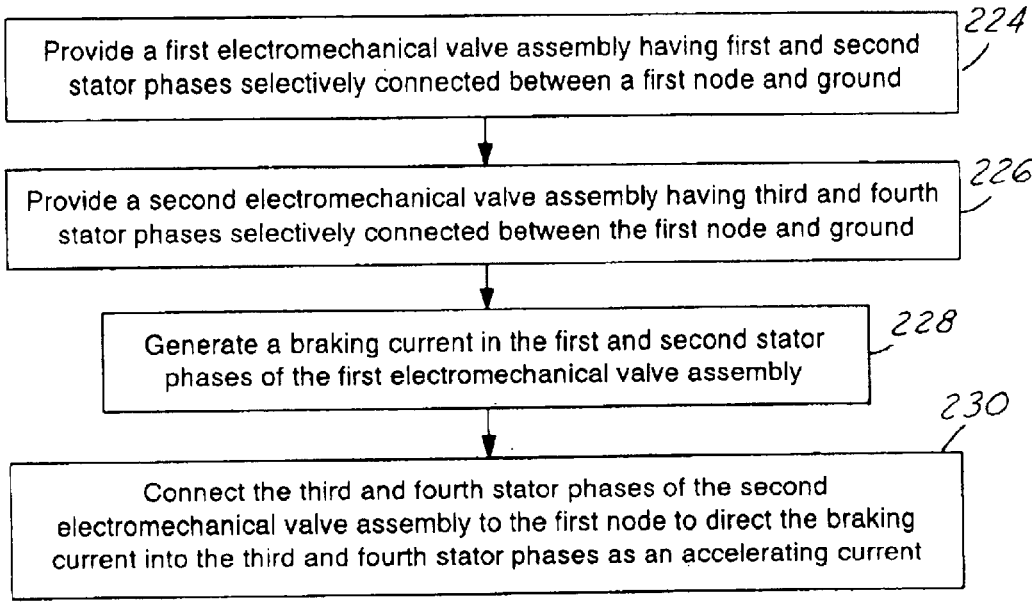
FIG. 19 is a flowchart illustrating a method for current recirculation in electromechanical valve assemblies in accordance with the present invention.

Referring to FIG. 19, a method for current recirculation (i.e., energy recover) in the electromechanical valve assemblies 46, 48 is provided. Those skilled in the art will recognize that current recirculation during operation of the intake and exhaust valve assemblies 46, 48, will result in increased engine efficiency. In particular, the method utilizes a braking current—generated when a valve is closing in the exhaust valve assembly 48—as an accelerating current to open a valve in the intake valve assembly 46. It should be understood, however, that the method could be implemented with any two valve assemblies in the engine 36 where one valve assembly is closing a valve and a second valve assembly is simultaneously opening a valve.

Referring to FIGS. 15 and 19, the method for current recirculation includes a step 224 of providing an exhaust valve assembly 48 having stator phases D and E selectively connected between a node 196 and ground. The method further includes a step 226 of providing an intake valve assembly 46 having stator phases A and B selectively connected between node 196 and ground.

The method further includes a step 228 of generating a braking current $I_{CP}$ in phases D and E of the exhaust valve assembly 48. Referring to FIGS. 18A and 18B, between crankshaft angles $\theta_0$ and $\theta_2$, the exhaust valve assembly 48 is closing a valve and is generating a braking current $I_{CP}$ (i.e., a negative current). Referring to FIG. 15, when the phases D and E of valve assembly 48 are generating a negative current $I_{CP}$ (i.e., $-I_{CP}$), the current flows through the node 196 common to all commutation circuits 194.

Finally, the method further includes a step 230 of connecting the stator phases A, B of the intake valve assembly 46 to the node 196 to direct the braking current $I_{CP}$ into stator phases A, B as an accelerating current $I_{CP}$. Referring to FIGS. 18A, 18B, and 18C, between crankshaft angles $\theta_0$ and $\theta_2$, the intake valve assembly 46 utilizes the braking current $I_{CP}$ generated by the exhaust valve assembly 48 to open the valve 70.

Referring to FIG. 2, a power distribution system 40 is provided for the engine control system 38 and the engine 36. The power distribution system 40 includes an alternator 232, a battery 234, a battery 236, and a DC/DC converter 238.

The alternator 232 is provided to maintain the state of charge in the battery 234 and the battery 236 at an adequate operational level. The alternator 232 is conventional in the art and may comprise a high power density 42 Vdc permanent-magnet enhanced water-cooled unit. Further, the alternator 232 may have a power rating of 2.5–3.5 Kilowatts to provide adequate power for the valve assemblies 46, 48 and for the remaining electrical components of the vehicle 34. The alternator 232 is driven by the crankshaft 60 and generates a current that is applied to the battery 234 and the DC/DC generator 238.

The battery 234 provides a 42 Vdc voltage to the valve controller 134 and is conventional in the art. It should be understood that the valve assemblies 46, 48 operate more efficiently utilizing a 42 Vdc voltage versus a 12 Vdc voltage. In particular, the valve controller 134 can generate a commanded valve position current $I_{CP}$ at a lower current level utilizing the 42 Vdc voltage as compared with utilizing a 12 Vdc voltage.

The battery 236 provides a 12 Vdc voltage to the engine controller 188 and is conventional in the art. The battery 236 is connected to the conventional DC/DC converter 238 which supplies a 12 Vdc charging voltage to the battery 236.

The electromechanical valve assembly 46 and the engine control system 38 represent a significant improvement over conventional valve assemblies and engine control systems. In particular, the valve assembly 46 and engine control system 38 enables the precise control of a valve dwell time, a valve opening rate, a valve closing rate, a valve dwell position, and valve phasing. As a result, the inventive valve assembly 46 allows for increased fuel efficiency and lower emissions in the engine 36 as compared with conventional valve assemblies. Further, the position of the valve 70 (and the valve head 84) may be accurately controlled for soft seating with a valve seat—resulting in reduced vehicle noise. Still further, the valve assembly 46 may be packaged in a relatively small package volume allowing automotive designers increased flexibility placement of the engine 36. Finally, the inventive method of current recirculation provides for decreased electrical energy consumption by the valve assemblies 46, 48 providing a longer operational life for a vehicle battery.

While the invention has been particularly shown and described with reference to the preferred embodiments thereof, it is well understood by those skilled in the art that various changes and modifications can be made in the invention without departing from the spirit and the scope of the-invention.

I claim:

1. An electromechanical valve assembly for an internal combustion engine, comprising:

a rotary electric actuator configured to rotate a ballnut; and, a valve having a valve stem and a valve head, said valve stem operatively connected to said ballnut, said valve stem configured to move generally axially responsive to the rotation of said ballnut to selectively engage and disengage said valve head with a valve seat of an engine cylinder.

2. A method for controlling a valve assembly in an engine, said assembly having a rotatable ballnut and a valve configured to move along a first axis in response to rotation of said ballnut, said method comprising:

rotating said ballnut to move a valve head against a valve seat of said engine; and, stopping said rotation of said ballnut upon an indication that said valve head has contacted said valve seat to prevent gas flow into or out of an engine cylinder.

3. A method for controlling a camless valve assembly in an engine, said engine having an engine cylinder, said valve assembly having a valve communicating with said cylinder, said method comprising:

opening said valve using an electrically driven ball-screw device at a first opening rate to control gas flow into said cylinder during a first combustion cycle of said cylinder; and, opening said valve using said ball-screw device at a second opening rate to control gas flow into said cylinder during a second combustion cycle of said cylinder.

4. An electromechanical valve assembly for an internal combustion engine, said valve assembly controlling gas communication between an engine cylinder and a gas conduit in said engine, said assembly comprising:

a rotor centered about a first axis;

a stator operatively disposed about said rotor for producing a torque to cause rotation of said rotor about said first axis; and, a valve having a valve stem and a valve head, said valve configured to move said valve head toward a valve seat of said engine when said rotor rotates in a first direction, said valve head movement being stopped upon an indication that said valve head has seated against said valve seat.

5. The electromechanical valve assembly of claim 4 wherein said indication corresponds to a measured position of said valve head being equal to a predetermined position of said valve when said valve head seats against said valve seat.

6. An internal combustion engine, comprising:

an engine cylinder; and, a camless valve assembly having a valve communicating with said engine cylinder, said assembly adjusting an opening rate of said valve to control gas flow into said engine cylinder, wherein said camless valve assembly includes an electrically driven ball-screw arrangement to axially move a valve head.

7. An electromechanical valve assembly for an internal combustion engine, said engine having an engine cylinder, said assembly comprising:

a rotor centered about a first axis having a bore extending generally axially therethrough;

a stator operatively disposed about said rotor for producing a torque to cause rotation of said rotor about said first axis;

a valve having a valve stem and a valve head, said valve stem configured to move upwardly when said rotor rotates in a first direction to move said valve head against a valve seat of said engine cylinder to prevent gas flow into or out of said engine cylinders; and further comprising a magnet disposed on said rotor and a magneto-strictive sensor adjacent said rotor, said sensor generating a position signal responsive to a rotational position of said magnet.

8. An electromechanical valve assembly for an internal combustion engine, said engine having an engine cylinder, said assembly comprising:

a rotor centered about a first axis having a bore extending generally axially therethrough;

a stator operatively disposed about said rotor for producing a torque to cause rotation of said rotor about said first axis;

a valve having a valve stem and a valve head, said valve stem configured to move upwardly when said rotor rotates in a first direction to move said valve head against a valve seat of said engine cylinder to prevent gas flow into or out of said engine cylinder; and wherein said rotor includes an outer ring magnet and an inner ballnut adjacent said ring magnet, said inner ballnut defining said bore.

9. The electromechanical valve assembly of claim 8 wherein said outer ring magnet comprises first and second magnet segments disposed adjacent one another.

10. An electromechanical valve assembly for an internal combustion engine, said engine having an engine cylinder, said assembly comprising:

a rotor centered about a first axis having a bore extending generally axially therethrough;

a stator operatively disposed about said rotor for producing a torque to cause rotation of said rotor about said first axis;

a valve having a valve stem and a valve head, said valve stem configured to move upwardly when said rotor rotates in a first direction to move said valve head against a valve seat of said engine cylinder to prevent gas flow into or out of said engine cylinder; and further comprising a centering spring and an enclosure, said stator and said rotor being disposed in said enclosure, said centering spring contacting said enclosure and a first end of said valve stem for moving said valve to a predetermined axial position when said stator is de-energized.

11. An electromechanical valve assembly for an internal combustion engine, said engine having an engine cylinder, said assembly comprising:

a rotor centered about a first axis having a bore extending generally axially therethrough;

a stator operatively disposed about said rotor for producing a torque to cause rotation of said rotor about said first axis;

a valve having a valve stem and a valve head, said valve stem configured to move upwardly when said rotor rotates in a first direction to move said valve head against a valve seat of said engine cylinder to prevent gas flow into or out of said engine cylinder; and wherein said valve has a bore therein, said valve further comprising a magneto-strictive sensor with a metal shaft disposed axially within said bore of said valve, said magneto-strictive sensor generating a position signal indicative of an axial position of said valve.

12. An electromechanical valve assembly for an internal combustion engine, comprising:

a rotor centered about a first axis having a bore extending generally axially therethrough, said rotor having a first helical groove;

a stator operatively disposed about said rotor for producing a torque to cause rotation of said rotor about said first axis, said stator being formed of a plurality of laminated plates;

a valve having a valve stem and a valve head, said valve stem extending generally axially through said bore of said rotor, said valve stem having a second helical groove, said first and second helical grooves forming a raceway between said rotor and said valve stem for holding ball bearings therein and, a plurality of ball bearings disposed within said raceway wherein said valve moves axially responsive to rotation of said rotor to move said valve head against a valve seat in said engine to prevent gas flow into or out of an engine cylinder.

13. An electromechanical valve assembly for an internal combustion engine, said engine having an engine cylinder, said assembly comprising:

a rotor centered about a first axis having a bore extending generally axially therethrough;

a stator operatively disposed about said rotor for producing a torque to cause rotation of said rotor about said first axis;

a valve having a valve stem and a valve head, said valve stem configured to move upwardly when said rotor rotates in a first direction to move said valve head against a valve seat of said engine cylinder to prevent gas flow into or out of said engine cylinder; and wherein said rotor includes a first helical groove and said valve stem includes a second complemental helical groove, said first and second helical grooves forming a first raceway between said rotor and said valve stem, said valve assembly further including ball bearings disposed in said first raceway that allow axial movement of said valve responsive to rotation of said rotor.

14. The electromechanical valve assembly of claim 13 wherein said rotor is further configured to recirculate said ball bearings from an end position in said first raceway to a start position in said raceway.

15. The electromechanical valve assembly of claim 13 wherein said valve stem is threadably engaged with said rotor.

16. The electromechanical valve assembly of claim 13 wherein said valve stem has a multiple lead engagement with said rotor.

* * * * *